United States Patent [19]

Larinoff

[11] Patent Number: 5,056,592

[45] Date of Patent: Oct. 15, 1991

[54] IN-TUBE FLUID-CHANNELING BAFFELES FOR AIR-COOLED VACUUM STEAM CONDENSERS

[76] Inventor: Michael W. Larinoff, 370 Holly Hill Rd., Oldsmar, Fla. 34677

[21] Appl. No.: 564,601

[22] Filed: Aug. 9, 1990

[51] Int. Cl.[5] ..... F28B 9/08

[52] U.S. Cl. ..... 165/111; 60/693; 165/913

[58] Field of Search ..... 168/110, 111, 104.21, 168/913; 60/693

[56] References Cited

U.S. PATENT DOCUMENTS 4,426,959 1/1984 McCurley ..... 165/104.21

4,715m,432 12/1987 Paibert ..... 165/110

FOREIGN PATENT DOCUMENTS 1052831 11/1983 U.S.S.R. ..... 165/913

*Primary Examiner*—Albert W. Davis, Jr.

*Attorney, Agent, or Firm*—Dominik, Stein

[57] ABSTRACT

A device for condensing steam, the device including a bundle of long heat-exchange tubes extending from first and lower header means to second and upper header means defining paths for the steam as it moves from the lower header means toward the upper header means and for effecting a flow of steam upwardly and a flow of steam condensate downwardly within the tubes, and new baffling installed inside some of the tubes of the bundle to channel and separate the upward bulk flow of stream and the downward bulk flow of condensate so as to prevent interaction between the two fluids that disrupts normal flow and heat transfer.

14 Claims, 3 Drawing Sheets

IN-TUBE FLUID-CHANNELING BAFFELES FOR AIR-COOLED VACUUM STEAM CONDENSERS

BACKGROUND OF THE INVENTION

1. Field of the Invention

This invention relates to in-tube fluid-channeling baffles for air-cooled vacuum steam condensers and, more particularly, to new fluid-channeling baffles for installation inside steam condensing tubes to prevent fluid flow disruptions between the high velocity upwardly flowing steam and the downwardly flowing condensate which degrades the tube heat-transfer rates in bundles that employ cost-saving, long-length, heat exchange tubes.

2. Summary of the Background Art

This invention relates to cost-related improvements in the apparatus of the type disclosed in U.S. Pat. No. 4,905,474 entitled Air-Cooled Vacuum Steam Condenser. The present invention permits the use of cost-saving, longer length, steam condensing tubes and also increases the overall heat transfer efficiency. It concerns the design of new fluid-channeling baffles installed inside some of the finned steam-condensing tubes.

U.S. Pat. No. 4,905,474 describes an A-frame type of bundle and fan arrangement where the steam and condensate movement inside the finned tubes is counterflow. The steam moves upward into and through the tubes while the condensate flows downward by gravity back to the steam source.

When certain tube lengths are exceeded, a condensate flow problem occurs inside the steam condensing tubes. Depending on factors such as the steam velocity entering the tubes, steam density, tube diameter and tube shape, fluid flow turbulence or disruptions can occur. Condensate flowing down the bottom of the tube in an orderly stream manner is interrupted by high velocity steam flowing upwardly in the opposite direction. The kinetic energy of the steam velocity is transferred to the condensate with many different forces playing a key role. Such forces include gravity, momentum, friction and surface tension. The net result is that both vapor-shear and gravity forces take control of the condensate fluid flow which becomes erratic, wavy and stratified. Slugs of liquid are momentarily formed that block the normal flow of steam and condensate inside the tubes. Depending upon the severity of the situation, the condensate may periodically hold-up inside the tubes and flow out of the ends in spurts and globs accompanied by some turbulent fluid noises.

This unsteady fluid flow along sections of the tube length creates thick condensate films on the wall surfaces that act as heat insulation. This degrades the log-mean-temperature-difference (LMTD) and the overall heat transfer rates of the process. It also hastens condensate freezing in some localized areas of the tubes.

This erratic pulsating condensate flow problem can be avoided by preventing it from occurring before it starts. The fluid boundary between condensate and steam flowing inside and inclined tube is horizontal, therefore, if a horizontal baffle were installed to continue the fluid separation by channeling it into the lower reaches of the tube where the most severe turbulent action takes place, this would essentially stop the interchange of energy. A baffle would prevent the high-velocity steam from imparting its disruptive energy to the condensate flowing in the opposite direction. There will be some steam flowing below the baffle and above the condensate stream, but it will be of no consequence since its energy content will be small and will be quickly dissipated compared to the energy content of the mass bulk of steam-flow above the baffle.

The region of disruptive flow is of some infinite tube length that starts at the tube entrance and stops at some point further up into the tube. In all cases the maximum steam velocity is at the tube entrance while the minimum, zero velocity, is at the rear header. The disruptive steam velocity starts at the tube entrance and ends at some mid-point well below the rear header depending on the many variable factors previously mentioned.

The baffle sections need not be installed in bundles with normal length steam condensing tubes. The baffle sections also need not be installed for the full tube lengths nor in all tube rows of bundles with long tubes. They should only be installed in those portions of the tube lengths that have steam velocities high enough to cause flow disruptions. In addition, to save material costs, the baffle sections need not be continuous in length but can be interrupted with voids in-between. Some small condensate waves that may be induced in the short open sections will be quickly dampened after the flow passes the next baffle section.

The condensate flowing on the bottom of the tubes is reheated by warm metal tabs protruding downward from the new baffle plates. The baffle plates are surrounded by steam so that its temperature is very nearly that of the saturated steam. These tabs are designed and positioned in the condensate stream path to maximize heat transfer to the condensate. The higher the condensate temperature that is returned to the power plant cycle, the higher the plant thermal efficiency.

As illustrated by a great number of prior patents and commercial devices, efforts are continuously being made in an attempt to improve air-cooled vacuum steam condensers. Such efforts are being made to render such vacuum steam condensers more efficient, reliable, inexpensive and convenient to use. None of these previous efforts, however, provide the benefits attendant with the present invention. Additionally, prior patents and commercial devices do not suggest the present inventive combination of component elements arranged and configured as disclosed herein. The present invention achieves its intended purposes, objects and advantages through a new, useful and unobvious combination of component elements, with the use of a minimum number of functioning parts, at a reasonable or lower cost to manufacture, and by employing only readily available materials.

Therefore, it is an object of the present invention to provide an improved device for condensing steam, the device including a bundle of long heat-exchange tubes extending from first and lower header means to second and upper header means defining paths for the steam as it moves from the lower header means toward the upper header means and for effecting a flow of steam upwardly and a flow of steam condensate downwardly within the tubes, and baffling located in some of the tubes of the bundle to channel and thus separate the bulk of the upward flow of steam from the bulk of the downward flow of the condensate.

It is a further object of the present invention to prevent high-velocity vapor fluid forces from opposing and disrupting the gravity flow of condensate inside a tube.

It is a further object of the present invention to channel and thus separate the bulk flow of the two fluids, a vapor and a liquid, thereby preventing the kinetic energy of one fluid from imparting its disturbing and disruptive energy to the other fluid.

It is a further object of the present invention to position a perforated baffle within a heat-exchange tube having liquids and vapors flowing in opposite directions so that its metal protrusions will reheat the flowing condensate.

It is a further object of the present invention to permit the use of longer and more economic steam condensing tubes without experiencing heat transfer degradation caused by disruptions in the fluid flow.

It is a further object of the invention to improve the overall heat transfer rates of condenser tubes which have baffles.

It is a further object of the present invention to increase the condensate temperature of those sections of tubes which have baffles.

The foregoing has outlined some of the more pertinent objects of the present invention. These objects should be construed to be merely illustrative of some of the more prominent features and applications of the intended invention. Many other beneficial results can be attained by applying the disclosed invention in a different manner or by modifying the invention within the scope of the disclosure. Accordingly, other objects and a fuller understanding of the invention may be had by referring to the summary of the invention and the detailed description of the preferred embodiments in addition to the scope of the invention defined by the claims taken in conjunction with the accompanying drawings.

SUMMARY OF THE INVENTION

The invention is defined by the appended claims with the specific embodiments shown in the attached drawings. For the purpose of summarizing the invention, the invention may be incorporated into an improved conduit arrangement for use in a steam powered system comprising a turbine for converting steam energy into mechanical energy upon expansion of steam therein, a boiler for generating steam to be fed to the turbine, and a conduit arrangement coupling the boiler to the turbine and then re-coupling the turbine exhaust to the boiler, the improved conduit arrangement including (1) a plurality of long heat-exchange tubes through which the expanded steam flows and is condensed; (2) a plurality of front, first headers at the lower ends of the condensing tubes for receiving exhaust steam of the turbine; (3) a plurality of rear, last headers, one for each row of condensing tubes at the higher ends of the condensing tubes for receiving non-condensible gasses; (4) means associated with the rear, last headers to remove non-condensible gasses from the tube ends and (5) means within a part of the length of some of the tubes to channel and thus separate the bulk flows of steam and condensate.

The invention may also be incorporated into a device for condensing steam, the device including a bundle of long heat-exchange tubes extending from first and lower header means to second and upper header means defining paths for the steam as it moves from the lower header means toward the upper header means and for effecting a flow of steam upwardly and a flow of steam condensate downwardly within the tubes, and baffling located in some of the tubes of the bundle to channel and thus separate the upward bulk flow of steam and the downward bulk flow of condensate.

Lastly, the invention may also be incorporated into apparatus for controlling the flow of fluids, the apparatus including a long heat exchange tube having a first end and a second end, the first end positionable adjacent to a supply of condensible vapor material which is movable toward the second end, the tube having an interior surface upon which the vapor material condenses and flows downwardly and back toward the first end, the apparatus also including baffle means located within the tube to channel and thus separate the bulk flow of vapor material from the bulk flow of condensate within the tube.

The second end is elevated with respect to the first end. The baffle means is a plate protruding slightly beyond the lower end of the tube and extending parallel with the horizontal axis of the tube. The slight protrusion of the baffle outside the tube inlet provides some shielding and protection of the discharging condensate from the incoming high velocity steam. The baffle plate further includes a support means associated with respect to the baffle plate to provide a plurality of contact points with the interior of the tube. The apparatus further includes tabs extending downward from the baffle to effect a thermal transfer between the steam and condensate. The apparatus further includes aperture means in the support means to allow for the free flow of steam laterally in the region above the baffle. The apparatus further includes aperture means in the baffle plate to allow for the flow of condensate to below the baffle plate. The baffle plate further includes means to position it and hold it inside the tube. The support means may be a plate attached essentially perpendicular to the baffle which provides support contact with the interior of the tube. The baffle plate may also be constructed by extending its width and bending that portion upward so as to provide contact pressure with the interior of the tube. The number of contact points between the baffle element and the finned tube is important only for the adequate support of the baffle plate and any fluid forces it may be subject to. A third form of baffle design could be a small tube resting on, and fastended to, the bottom of the steam condensing tube with apertures therein to allow the condensate to flow inside the small tube.

The foregoing has outlined rather broadly the more pertinent and important features of the present invention in order that the detailed description of the invention that follows may be better understood so that the present contribution to the art can be more fully appreciated. Additional features of the invention will be described hereiafter which form the subject of the claims of the invention. It should be appreciated by those skilled in the art that the conception and the disclosed specific embodiments may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objectives of the invention, reference should be made to the detailed description taken in conjunction with the accompanying drawings in which.

Similar reference numerals refer to similar parts throughout the various Figures.

DETAILED DESCRIPTION OF THE INVENTION

This invention relates to the apparatus of the type disclosed in U.S. Pat. No. 4,905,474 and the subject matter of such patent is incorporated by reference herein.

Figures 1, 2, 3, 4, 5, 7, 8:
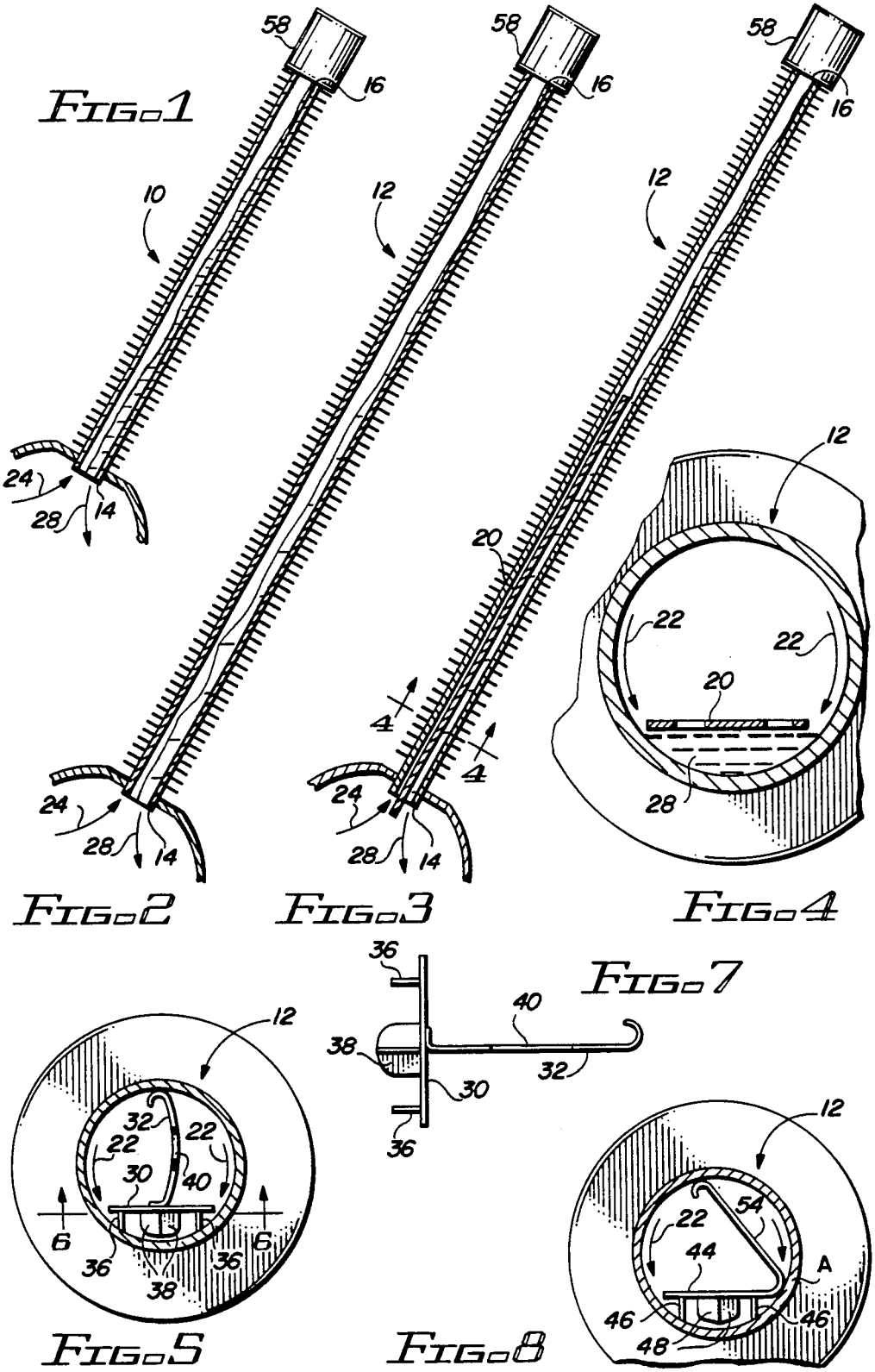
FIG. 1 shows a steady-state flow of steam and condensate in the bottom row of a bundle with normal length tubes installed in a typical A-frame structure.
FIG. 2 shows a disrupted and wavy condensate flow created by the high steam velocity entering a long condenser tube.
FIG. 3 is the same as FIG. 2 but with an in-tube baffle installed for a portion of the tube length, the condensate flow having been stabilized by the channeling of the two fluids.
FIG. 4 is an end view of FIG. 3 showing an unsupported horizontal baffle that channels and thus separates the two fluids with a passage space between it and the tube walls, wherein condensate flowing on the tube walls flows below the baffle at this point and into a quiescent channel.
FIG. 5 is the same as FIG. 4 except that the baffle is now provided with a support member to hold it inside the tube.
FIG. 7 is an end view of the baffle element before it is inserted into a finned tube as shown in FIG. 5.
FIG. 8 is an alternative design baffle that serves the identical function as that of FIG. 5.

Moderate length tubes 10, prior art tubes as shown in FIG. 1, have steady condensate discharge with no disruptive fluid flow problems and require no in-tube baffles. The steam velocity entering the tubes is not high enough to upset the normal gravity-flow of the condensate downwardly. When condenser economics indicate the desirability for a longer length conduit, pipe or tube 12, as shown in FIGS. 2, 3, etc., fluid flow can become erratic and pulsating starting at the bottom lower end 14 and stopping somewhere before it reaches the upper top end 16. With longer tubes, more steam enters the tube and its higher velocity and kinetic energy disrupt the normal condensate flowing on the bottom of the tube 12. Note that the upper regions of tube 12 have a steady state condensate flow similar to FIG. 1 but that the lower regions and its end 14, with its high steam velocities, have fluid disruptions.

To prevent these disruptions, a baffle 20 is inserted between upwardly flowing steam 24 and downwardly flowing condensate stream flow 28, as shown in FIGS. 2, 3 and 4. This baffle is located essentially at the normal level of the condensate stream flow 28. By channeling and thus separating the two fluids, steam and condensate, the baffle 20 prevents the high velocity steam from transferring its kinetic energy to the counter-moving condensate. The condensate 22 that forms on the tube walls flows past the baffle 20 and joins the condensate stream flow 28 as shown in FIG. 4. The condensate that lands on the top of the baffle 20 flows downward therefrom through holes in the baffle.

Baffle 20 in FIG. 4 is placed on the surface of the condensate stream flow 28 to illustrate the means proposed for the separation of the two fluids. There is no physical support shown for this baffle 20 as that is another item of design.

Figure 5A:
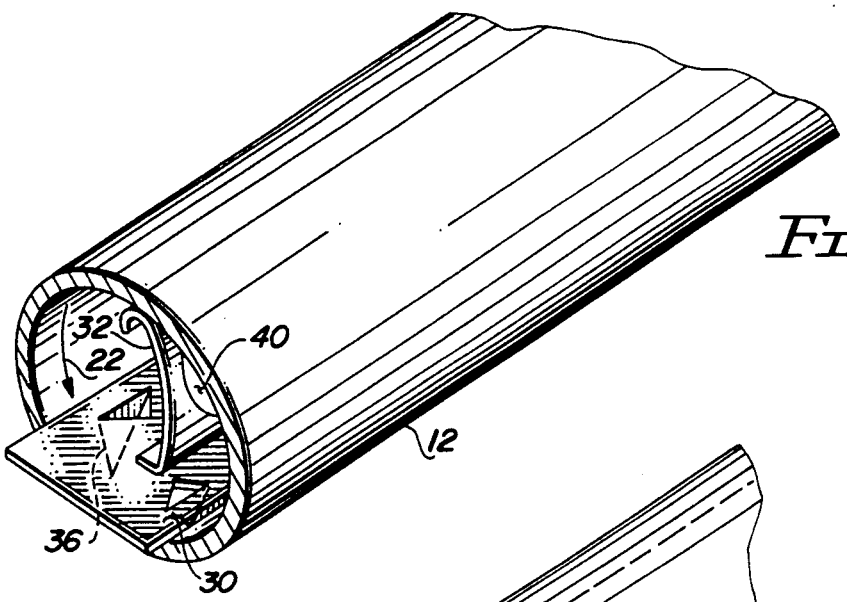
FIG. 5A is a perspective illustration of the FIG. 5 showing.

FIGS. 5 and 5A show one way that such a baffle could be supported inside the tube. A baffle 30 has a vertical compression member 32 attached to it and is bent slightly at the time of insertion into the tube so that it bears down on baffle 30 by means of elastic metal forces that hold it in place by friction. The baffle 30 is seated in the tube by a three point contact; one is on the top of compression member 32 and the other two are located along the outer edges of the baffle as support tabs 36.

Figure 6:
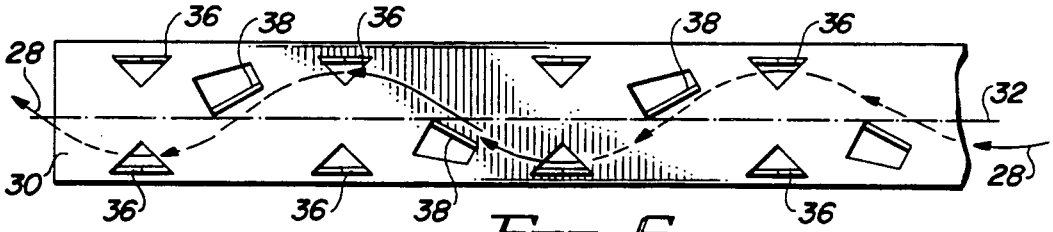
FIG. 6 is a bottom view of the baffle plate taken along line 6—6 of FIG. 5 showing the support tabs and condensate heating tabs.

FIGS. 6 and 7 show in greater detail both the baffle support tabs 36 and the condensate heating tabs 38. The heating tabs 38 protrude downward from baffle 30 and are positioned in the condensate stream flow 28 at an angle for maximum heat transfer. Tabs 36 and 38 are formed simply by die stamping the baffle sheet metal to the shapes shown with the tabs protruding downward. The vertical compression member 32 has passage holes or large steam-pressure equalizing openings 40 cut out to facilitate lateral steam flow to either side of this member 32 and equalize steam pressure differences.

Figure 8A:
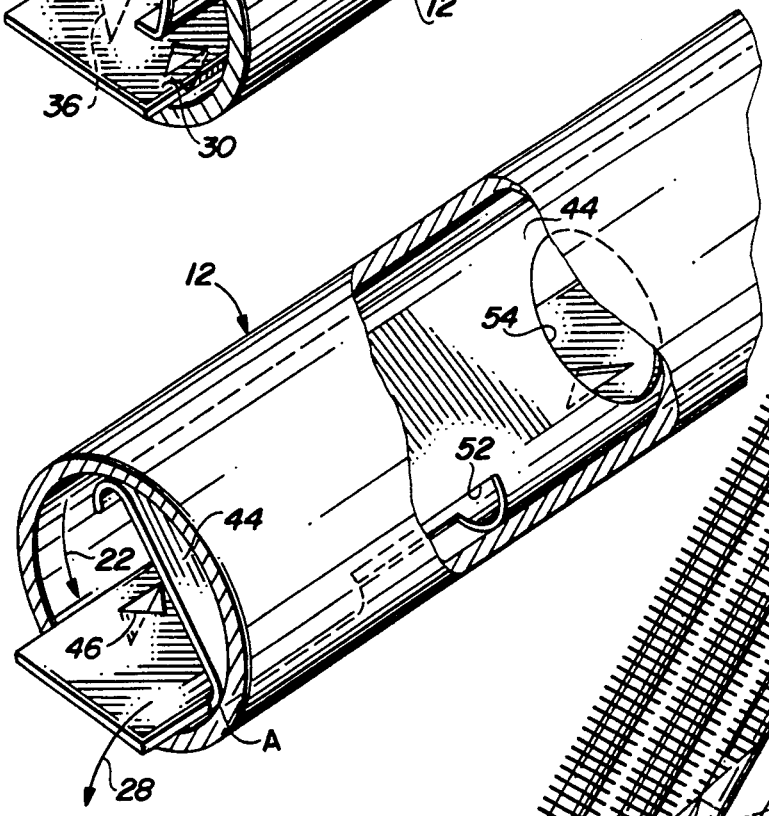
FIG. 8A is a perspective illustration of the FIG. 8 showing.
Figure 9:
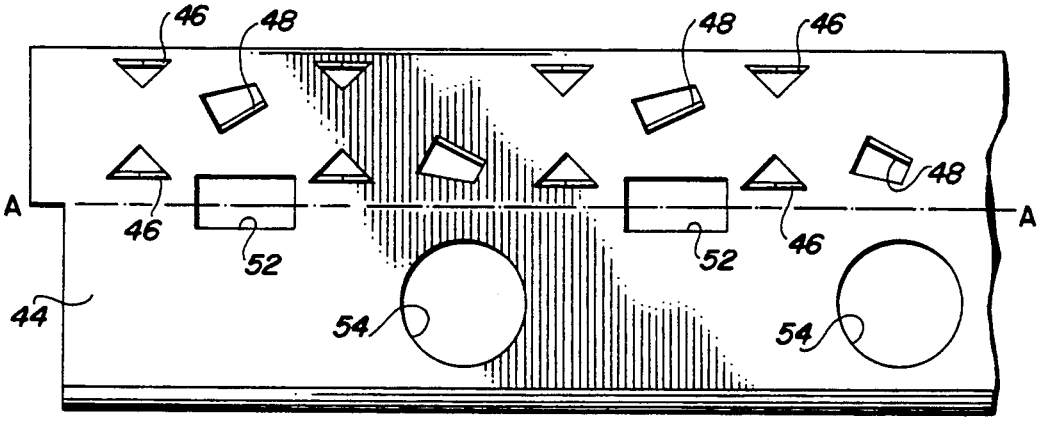
FIGS. 9 and 10 are enlarged plan and end view of FIG. 8 but prior to bending and showing the support tabs, condensate heating tabs and steam-pressure equalizing passages.
Figure 10:
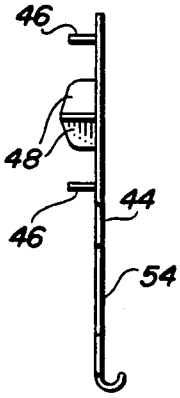

Another design of baffle support is shown in FIGS. 8 and 8A. Here the baffle 44 and its support are fabricated from a single piece of sheet metal rather than two pieces shown in FIG. 5. A plan and end view of the metal stamping is shown in FIGS. 9 and 10. This shows the baffle support tabs 46, the condensate heating tabs 48, the condensate wall-drain openings 52 and the steam-pressure equalizing openings 54. The flat plate is bent along axis A—A as shown in FIG. 9 and inserted into the tube 12 as shown in FIGS. 8 and 8A. In its installed position, the condensate 22 draining from the tube walls passes through openings 52 to join the condensate stream flow 28.

Figure 11:
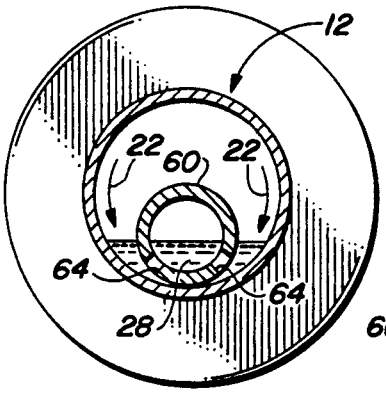
FIG. 11 is an alternative design baffle serving the same function as FIGS. 5 and 8 but employing a perforated small condensate drain tube.
Figure 11A:
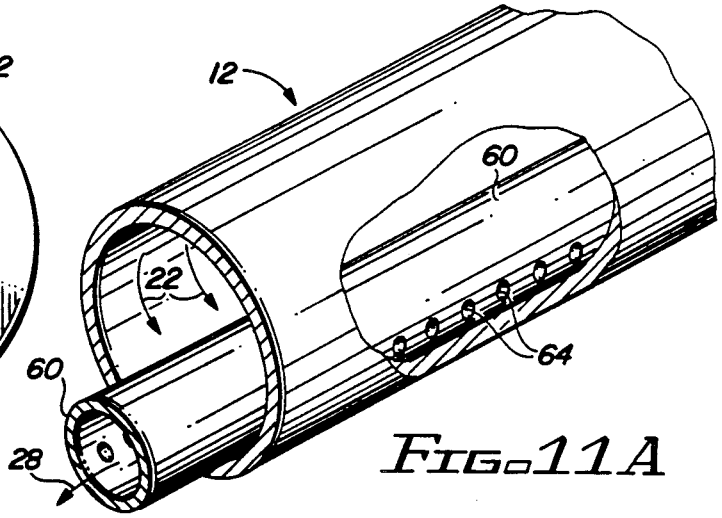

A further design of the baffle is shown in FIGS. 11 and 11A where a small interior conduit, pipe or tube 60, with suitable openings 64 along its sides below the centerline, allows condensate to enter and flow through it up to the point of its discharge at the end of the heat-exchange tube. The top of the tube protects the condensate stream flow 28 from the high velocity upwardly flowing steam 24. The lowermost extent of the small tube is secured to the finned tube along their line of contact.

These baffles, FIGS. 5, 8 and 11, illustrate the many ways they can be built and supported. The baffle design that would be selected is the one that is the lowest cost to manufacture and install. These baffles are lightweight and held in place by friction contact inside the tubes and welded at the tube ends if necessary. They are not subject to large fluid forces because there are no large forces present. Condensate disturbances that have the potential for generating large forces are stopped before they start by channeling and separating the fluids.

The baffle elements 20, 30, 44 and 60 are fabricated in small lengths that are convenient to handle, such as 2 or 4 feet. They are installed by inserting them into the tube 12 at the steam header end 14 and pulling them into position by a small cable from tube end 16.

Figure 12:
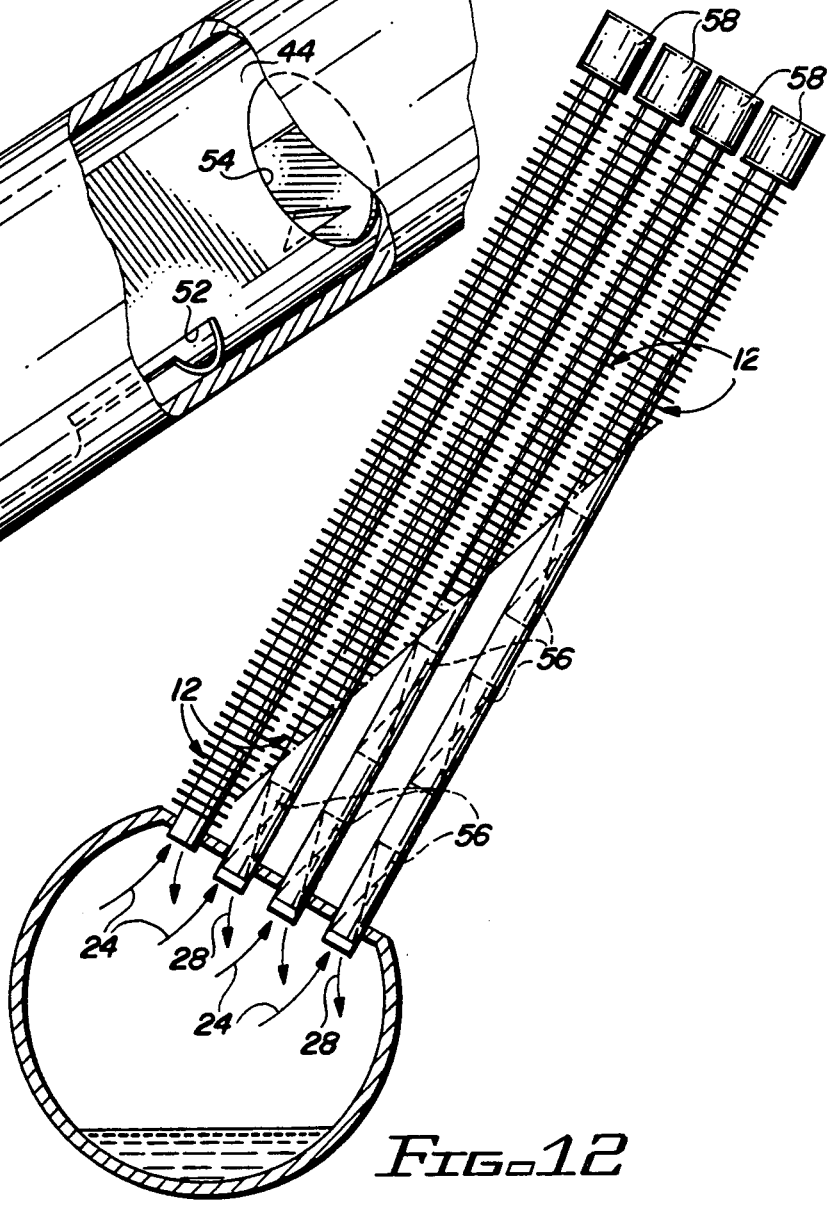
FIG. 12 is a typical four row bundle with in-tube, fluid-channeling baffle elements installed in selected tube areas.
Figure 13:
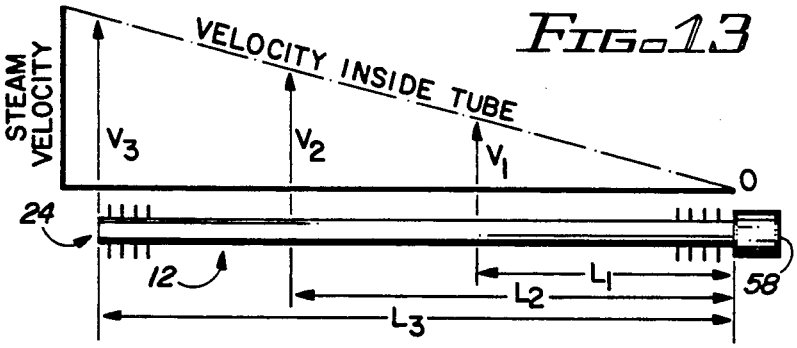
FIG. 13 is a steam velocity profile plot showing the in-tube steam velocities at various points along the length of the tube.

FIG. 12 shows the baffle elements 56 installed in three of the four rows of a typical bundle which is the same as FIG. 2 in U.S. Pat. No. 4,905,474. The placement of these baffle elements 56 can best be explained by referring to FIG. 13. This plot shows a steam velocity profile for a typical steam condensing tube. The steam velocity inside the tube is zero at the rear header 58 and it increases nearly linearly with respect to tube length. If the tube length is doubled, then the quantity of steam condensed is also nearly doubled. The plot of FIG. 13 shows that if the tube length is L1, the entering steam velocity will be V1. If the length is increased to L2, then the velocity goes up to V2. A length L3 has a velocity of V3. Similarly, if the tube length is fixed at L3, then at point L2 the steam velocity will be V2 and at point L3 it is V3.

For a given operating situation of known steam density, tube diameter, tube shape and tube length L3 it is possible that fluid flow disruption can occur with a steam velocity of say V2 and higher. This means that the fluid between the tube entrance 14 and point L2, V2 will be in turmoil and will require in-tube baffles. Steam velocities must be examined in each tube row in a similar manner and baffle elements 56 installed from the tube entrances 14 up to the point where the steam velocity inside the tube is below its disruptive or turbulent level. For example, FIG. 12 shows the first row with three baffle elements 56, the second row with two baffle elements, the third row with one baffle element and the fourth row with no baffle elements. The baffle elements end where the disruptive or turbulent steam velocities would normally start. The baffle elements are installed only in the fluid disrupted areas inside the steam condensing tubes.

The present disclosure includes that contained in the appended claims as well as that of the foregoing description. Although this invention has been described in its preferred forms with a certain degree of particularly, it is understood that the present disclosure of the preferred form has been made only by way of example and that numerous changes in the details of construction and combination and arrangement of parts may be resorted to without departing from the spirit and scope of the invention.

Now that the invention has been described, what is claimed is:

1. For use in a steam powered system comprising a turbine for converting steam energy into mechanical energy upon expansion of steam therein, a boiler for generating steam to be fed to the turbine, and a conduit arrangement coupling the boiler to the turbine and then re-coupling the turbine exhaust to the boiler, the conduit arrangement including (1) a plurality of long heat-exchange tubes through which the expanded steam flows and is condensed; (2) a plurality of front, first headers at the lower ends of the condensing tubes for receiving exhaust steam of the turbine; (3) a plurality of rear, last headers, one for each condensing tube row at the higher ends of the condensing tubes for receiving non-condensible gasses; (4) means associated with the rear, last headers to remove non-condensible gasses from the tube ends, and (5) means within a part of the front length of some of the tubes to channel and thus separate the bulk flows of steam and condensate, said last mentioned means including apertures along the length thereof.

2. A device for condensing steam, the device including a bundle of long heat exchange tubes extending from first and lower header means to second and upper header means defining paths for the steam as it moves from the lower header means toward the upper header means and for effecting a flow of steam upwardly and a flow of steam condensate downwardly within the tubes, and baffling located within the tubes of the bundle to channel and thus separate the upward bulk flow of steam and the downward bulk flow of condensate, said baffling having aperture means along the length thereof.

3. Apparatus for controlling the flow of fluids, the apparatus including a tube having a first end and a second end, the first end positionable adjacent to a supply of condensible vapor material which is movable toward the second end, the tube having an interior surface upon which the vapor material condenses and flows downwardly and back toward the first end, the apparatus also including apertured baffle means located within the tube to channel and thus separate the flow of vapor material from the flow of condensate within the tube.

4. The apparatus as set forth in claim 3 wherein the second end is elevated with respect to the first end.

5. The apparatus as set forth in claim 4 wherein the baffle means is a plate adjacent to the lower end and extending parallel with the horizontal axis of the tube.

6. The apparatus as set forth in claim 5 wherein the baffle plate protrudes slightly beyond the tube inlet to provide some shielding and protection for the discharging condensate from the incoming high velocity steam.

7. The apparatus as set forth in claim 5 wherein the baffle plate further includes a support means associated with respect to the baffle plate to provide for its proper placement and sustainment inside the tube.

8. The apparatus as set forth in claim 7 and further including tabs extending downwardly from the baffle to effect a thermal transfer from the steam to the condensate.

9. The apparatus as set forth in claim 8 and further including aperture means in the support means to allow for the lateral flow of steam in the region above the baffle.

10. The apparatus as set forth in claim 9 and further including aperture means in the baffle plate to allow for the flow of condensate to below the baffle plate.

11. The apparatus as set forth in claim 10 wherein the baffle plate further includes a support means attached essentially perpendicular to the baffle plate to provide support contact with the interior of the tube.

12. The apparatus as set forth in claim 10 wherein the baffle means includes a bent upwardly extending portion to effect a support contact with the interior of the tube.

13. The apparatus as set forth in claim 4 where the baffle is a small tube resting on and fastened to the bottom of the steam condensing tube with apertures therein to allow the condensate to flow inside the small tube.

14. A device for condensing steam, the device including bundles of long heat exchange tubes extending from first and lower header means to second and upper header means defining paths for the steam as it moves from the lower header means toward the upper header means and for effecting a flow of steam upwardly and a flow of steam condensated downwardly through bottom channels within the tubes, and baffling with openings along the lengths thereof, the baffling located within selected tube rows of the bundle to remove most of the condensate continuously and immediately as it is formed on the inside walls of the condensing tubes by draining it directly by gravity flow past the openings of the baffles and into the bottom channels where the collective condensate flows in increasing amounts toward the steam source.

* * * * *